US008369733B2

(12) United States Patent
Kawai et al.

(10) Patent No.: US 8,369,733 B2
(45) Date of Patent: Feb. 5, 2013

(54) POWER FEEDING MECHANISM AND IMAGE FORMING APPARATUS

(75) Inventors: Jun Kawai, Saitama (JP); Shinichi Ohba, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 501 days.

(21) Appl. No.: 12/574,289

(22) Filed: Oct. 6, 2009

(65) Prior Publication Data

US 2010/0104312 A1 Apr. 29, 2010

(30) Foreign Application Priority Data

Oct. 29, 2008 (JP) ..... P2008-278940

(51) Int. Cl.
*G03G 15/00* (2006.01)

(52) U.S. Cl. ..... 399/88; 399/89; 399/90

(58) Field of Classification Search ..... 399/88–90
See application file for complete search history.

(56) References Cited

U.S. PATENT DOCUMENTS

| | | | | |
|---|---|---|---|---|
| 7,313,344 | B2 * | 12/2007 | Kuma et al. | 399/90 |
| 2005/0008393 | A1 | 1/2005 | Kuma et al. | |
| 2007/0160380 | A1 | 7/2007 | Imaizumi et al. | |
| 2007/0286632 | A1 | 12/2007 | Okabe | |

FOREIGN PATENT DOCUMENTS

| | | |
|---|---|---|
| JP | 9-6883 A | 3/1997 |
| JP | A-9-68833 | 3/1997 |
| JP | 11-282324 | 10/1999 |
| JP | 2004-347728 | 12/2004 |
| JP | 2005-242199 | 9/2005 |
| JP | 2007-071999 | 3/2007 |
| JP | 2007-213018 | 8/2007 |
| JP | 2007-264469 | 10/2007 |

OTHER PUBLICATIONS

Yano et al. (JP 09-068833, Mar. 1997) JPO Machine Translation.*

* cited by examiner

*Primary Examiner* — David Gray
*Assistant Examiner* — Erika J Villaluna
(74) *Attorney, Agent, or Firm* — Sughrue Mion, PLLC

(57) ABSTRACT

A power feeding mechanism includes: a power-fed body placed in an apparatus main body, the power-fed body into which power is fed at least when the power-fed body is used; a placement portion where the power-fed body provided in the apparatus main body is placed; a power feed member provided in the apparatus main body and configured to move between a noncontact position and a contact position, the power feed member at the contact position that feeds power into the power-fed body from the apparatus main body; and a move unit that moves the power feed member to at least the two positions. At the noncontact position, the power feed member is noncontact in electric with the power-fed body being placed in the placement portion. At the contact position, the power feed member is contact in electric with the power-fed body being placed in the placement portion.

6 Claims, 15 Drawing Sheets

POWER FEEDING MECHANISM AND IMAGE FORMING APPARATUS

CROSS-REFERENCE TO RELATED APPLICATIONS

This application is based on and claims priority under 35 USC 119 from Japanese Patent Application No. 2008-278940 filed on Oct. 29, 2008.

BACKGROUND

1. Technical Field

This invention relates to a power feeding mechanism and an image forming apparatus.

2. Related Art

An image forming unit attached to and detached from an image forming apparatus such as a printer has been developed. This image forming unit is provided with power-fed unit requiring power feed (for example, photoconductive body, charging unit, developing unit, transfer unit, etc.). When the image forming unit is attached to the apparatus main body of the image forming apparatus and is placed in a usable state, power is fed into the power-fed unit from the apparatus main body.

And, as a power feed terminal is provided in the apparatus main body for feeding power into the power-fed unit of the image forming unit, a power feed terminal projecting to the attachment space where the image forming unit is attached in the apparatus main body and fixed at a position where the power feed terminal is always in contact with the image forming unit has been developed.

SUMMARY

According to an aspect of the invention, a power feeding mechanism includes: a power-fed body that is placed in an apparatus main body, the power-fed body into which power is fed at least when the power-fed body is used; a placement portion where the power-fed body provided in the apparatus main body is placed; a power feed member that is provided in the apparatus main body and is configured to move between a noncontact position and a contact position, the power feed member at the contact position that feeds power into the power-fed body from the apparatus main body; and a move unit that moves the power feed member to at least the two positions. At the noncontact position, the power feed member is noncontact in electric with the power-fed body being placed in the placement portion. At the contact position, the power feed member is contact in electric with the power-fed body being placed in the placement portion.

BRIEF DESCRIPTION OF THE DRAWINGS

Exemplary embodiment(s) of the present invention will be described in detail based on the following figures, wherein.

DETAILED DESCRIPTION

Figure 1:
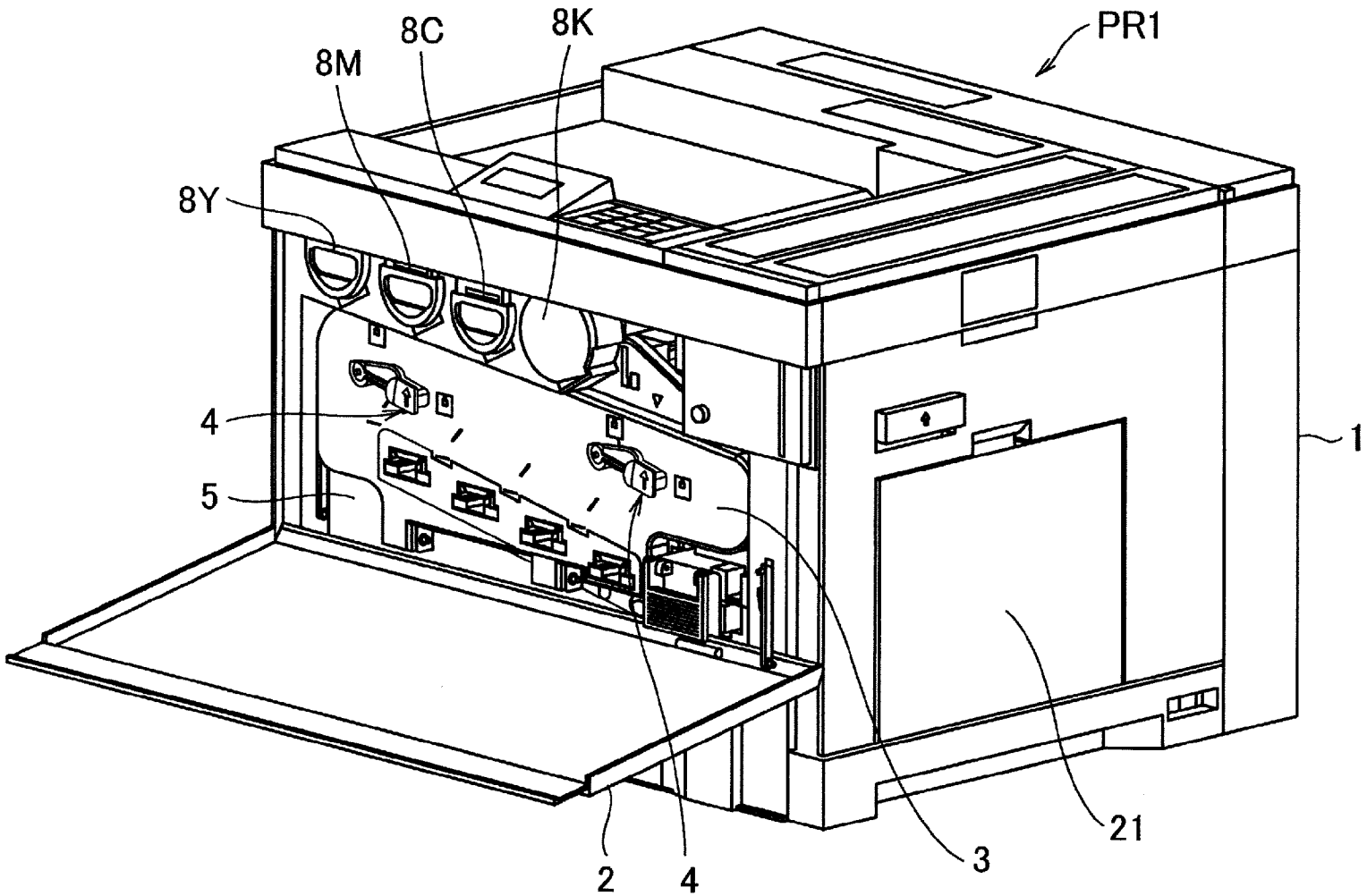
FIG. 1 is a perspective view to show the appearance of a printer as an image forming apparatus according to one exemplary embodiment of the invention.
Figure 2:
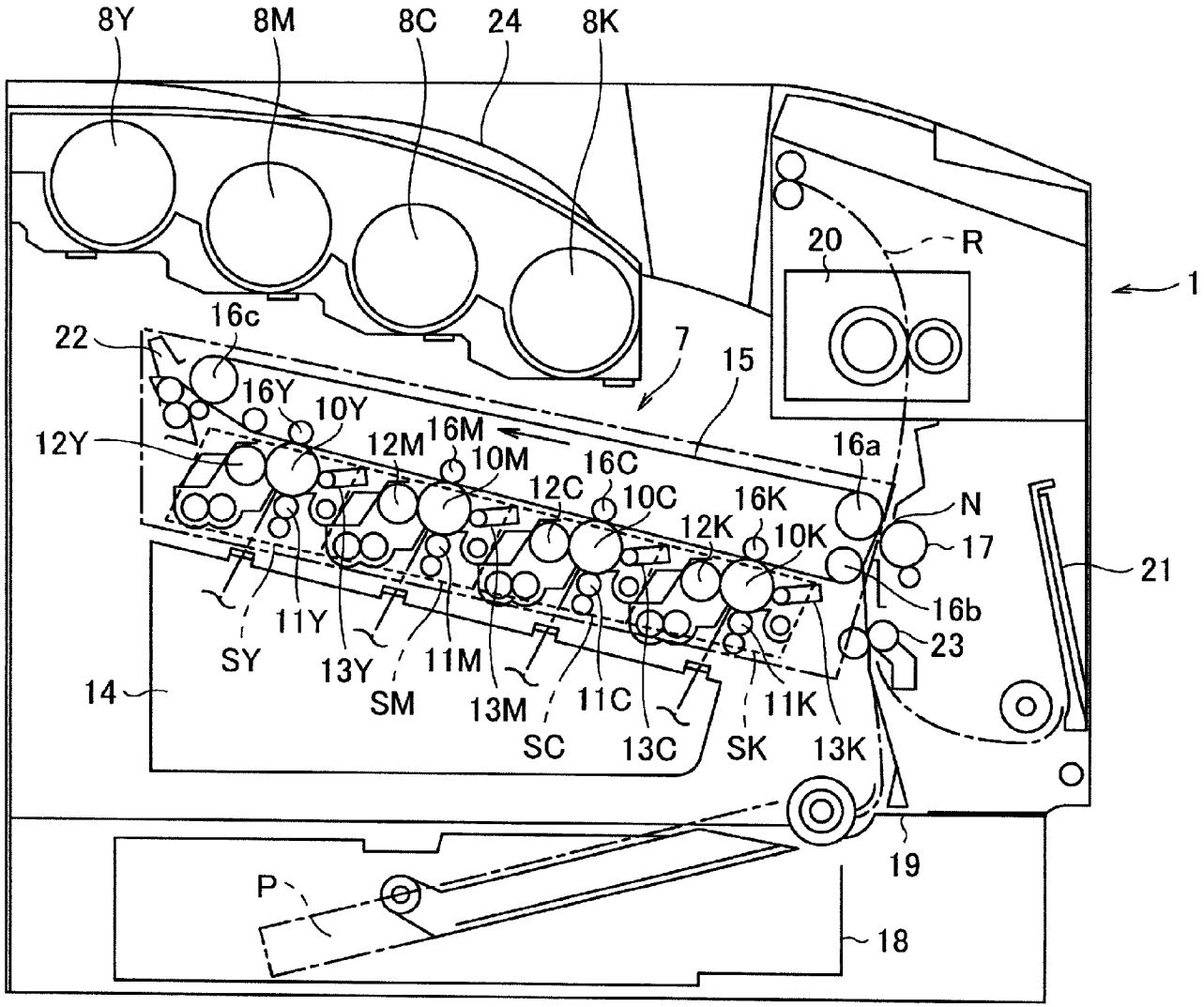
FIG. 2 is a schematic representation to show the internal configuration of the printer in FIG. 1.

An exemplary embodiment of the invention will be discussed in detail with reference to the accompanying drawings. In the drawings to describe the exemplary embodiment, identical components are denoted by the same reference numerals and will not be discussed again.

A printer PR1 as an image forming apparatus according to the exemplary embodiment of the invention will be discussed. Although not limited, it is assumed that the printer PR1 as the image forming apparatus shown in the exemplary embodiment is a full-color printer. However, it may be a color printer which is not a full-color printer or a monochrome printer.

The full-color printer executes the print operation using toners of four colors of yellow (Y), magenta (M), cyan (C), and black (B) based on image data sent from a personal computer, a scanner, etc., for example.

In FIG. 1, the printer PR1 has a storage section of print sheets as record media, a conveying mechanism of print sheets, an image forming unit for forming an image on print sheets, and the like which are housed in a resin cabinet 1 as an apparatus main body.

The image forming unit includes four image forming sections (an example of power-fed body) SY, SM, SC, and SK for forming toner images of colors of yellow (Y), magenta (M), cyan (C), and black (B). These image forming sections SY, SM, SC, and SK can be attached and detached separately.

Each of the four image forming sections SY, SM, SC, and SK has a similar configuration except for color of formed image and is made up of a photoconductive drum (an example of photoconductive body) 10 (10Y, 10M, 10C, 10K) for rotating at predetermined rotation speed, a charging roller (an example of charging unit) 11 (11Y, 11M, 11C, 11K) for charging the surface of the photoconductive drum 10Y, 10M, 10C, 10K at a predetermined potential, a developing device (an example of developing unit) 12 (12Y, 12M, 12C, 12K) for developing an electrostatic latent image formed on the photoconductive drum 10Y, 10M, 10C, 10K in the corresponding color toner, a cleaning device 13 (13Y, 13M, 13C, 13K) for cleaning transfer remaining toner left on the photoconductive drum 10Y, 10M, 10C, 10K, and the like.

Toner cartridges 8Y, 8M, 8C, and 8K storing toners (yellow (Y) toner, magenta (M) toner, cyan (C) toner, and black (B) toner) used for the developing devices 12Y, 12M, 12C, and 12K to develop the electrostatic latent images formed on the photoconductive drums 10Y, 10M, 10C, and 10K are detachably attached above the image forming sections SY, SM, SC, and SK.

The developing devices 12Y, 12M, 12C, and 12K supply, for example, dual-component or mono component developers stored in the toner cartridges 8Y, 8M, 8C, and 8K to developing rollers while agitating the developers, convey the developers to developing areas opposed to the photoconductive drums 10Y, 10M, 10C, and 10K while regulating the layer thickness of each of the developers supplied to the developing rollers, and develop the electrostatic latent images formed on the surfaces of the photoconductive drums 10Y, 10M, 10C, and 10K in predetermined color toners.

Accordingly, the developing devices 12Y, 12M, 12C, and 12K develop the electrostatic latent images formed on the photoconductive drums 10Y, 10M, 10C, and 10K as color toner images of yellow (Y), magenta (M), cyan (C), and black (B) respectively.

An exposure device (an example of latent image forming unit) 14 for exposing the images corresponding to the colors to form electrostatic latent images on the charged surfaces of the photoconductive drums 10Y, 10M, 10C, and 10K is placed below the image forming sections SY, SM, SC, and SK.

An intermediate transfer belt 15 (an example of intermediate body) put into a unit to which the toner images formed on the photoconductive drums 10Y, 10M, 10C, and 10K are transferred (an example of primary transfer) is provided so as to be able to come in contact with the photoconductive drums 10Y, 10M, 10C, and 10K between the image forming sections SY, SM, SC, and SK and the toner cartridges 8Y, 8M, 8C, and 8K. The intermediate transfer belt 15 can be attached to and detached from the cabinet 1, is placed on three rollers 16*a*, 16*b*, and 16*c* (any one roller is a drive roller and other rollers are driven rollers), and rotates in the direction indicated by the arrow in the drawing by the rollers 16*a*, 16*b*, and 16*c*. The toner images formed on the photoconductive drums 10Y, 10M, 10C, and 10K are transferred to the intermediate transfer belt 15 as they are put on each other, whereby a full-color toner image is formed on the intermediate transfer belt 15.

A cleaner 22 for removing the remaining toner on the intermediate transfer belt 15 is placed at a position opposed to the roller 16*c* with the intermediate transfer belt 15 therebetween.

Primary transfer rollers (an example of transfer unit) 16 (16Y, 16M, 16C, and 16K) for transferring the toner images formed on the photoconductive drums 10Y, 10M, 10C, and 10K to the intermediate transfer belt 15 are placed so as to sandwich the intermediate transfer belt 15 between the primary transfer rollers 16Y, 16M, 16C, and 16K and the photoconductive drums 10Y, 10M, 10C, and 10K. The primary transfer rollers 16Y, 16M, 16C, and 16K are built in the intermediate transfer belt 15 put into a unit and are attached and detached together with the intermediate transfer belt 15 in one.

A secondary transfer roller 17 for transferring the full-color toner image transferred to the intermediate transfer belt 15 to a sheet of paper P of a record medium is provided at a position opposed to the roller 16*a* so as to form a nip part N where the intermediate transfer belt 15 is sandwiched between the secondary transfer roller 17 and the roller 16*a*.

A sheet feed cassette 18 storing sheets P is placed in the bottom of the cabinet 1. A sheet of paper P taken one at a time by a pickup roller 19 from the sheet feed cassette 18 is conveyed on a sheet conveying passage R passing through a fixing unit 20 via the nip part N to a sheet discharge tray 24 formed in an upper part of the cabinet 1. When the sheet P is fed into the nip part N at a proper timing with a pair of registration rollers 23, the full-color toner image formed on the intermediate transfer belt 15 is transferred to the sheet P by the secondary transfer roller 17. Then, the transferred toner image is fixed by the fixing unit 20 and then is discharged onto the sheet discharge tray 24.

A manual tray 21 is provided on a side of the cabinet 1 and a sheet of paper P is also conveyed on the sheet conveying passage R from the manual tray 21.

A control unit is disposed in the cabinet 1 and is provided with an image processor for performing predetermined image processing for image data, for example.

Color image data of yellow (Y), magenta (M), cyan (C), and black (B) is output in order from the image processor to the exposure device 14 and four laser beams emitted from the exposure device 14 in response to the image data are scanned over the photoconductive drums 10Y, 10M, 10C, and 10K to form electrostatic latent images.

In FIG. 1, an outer door 2 that can be manually opened and closed is provided on one side of the cabinet 1 (front side in FIG. 1).

Figure 3:
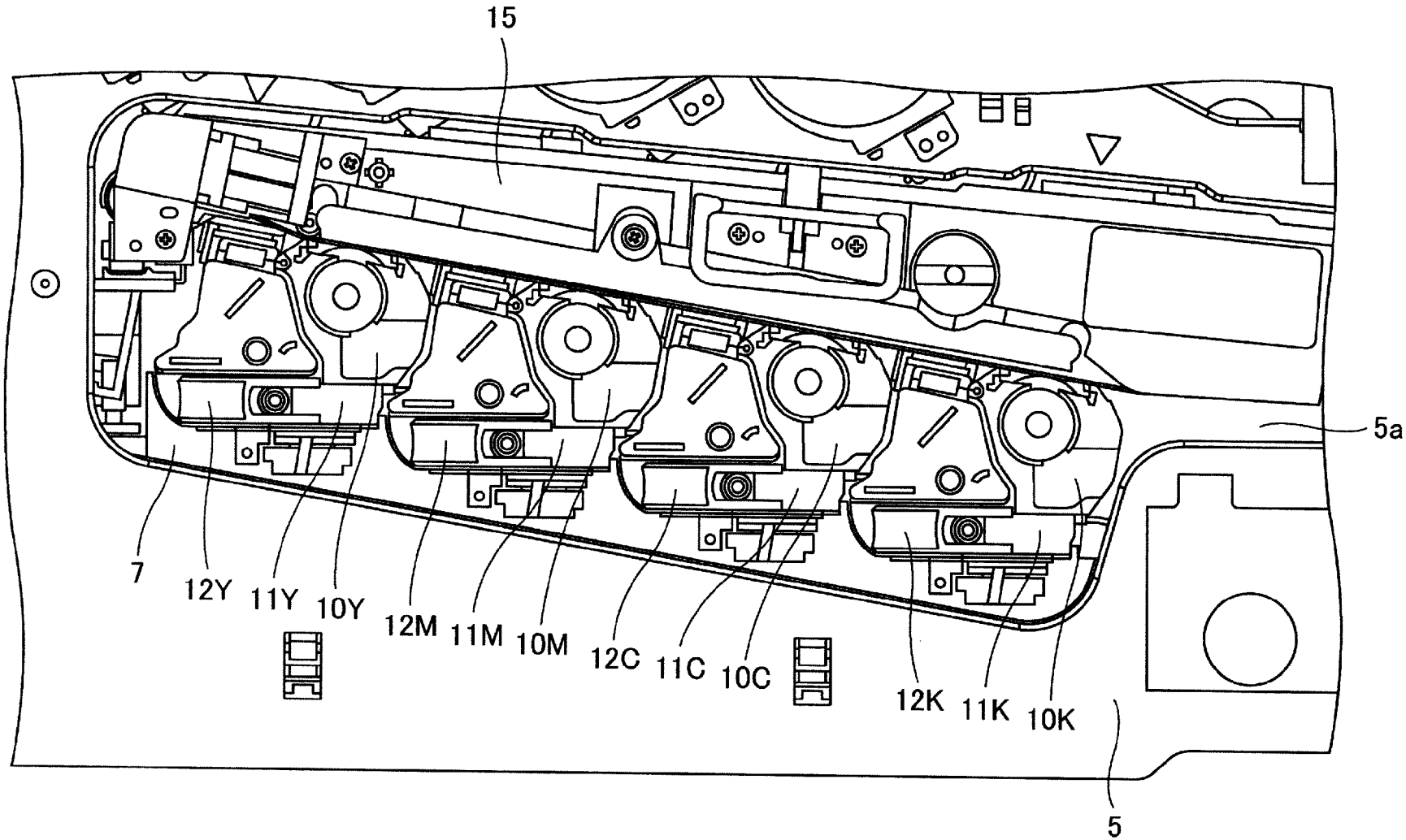
FIG. 3 is a drawing to show the internal structure of the printer in FIG. 1 in a state in which an outer door and an inner door are open.
Figure 4:
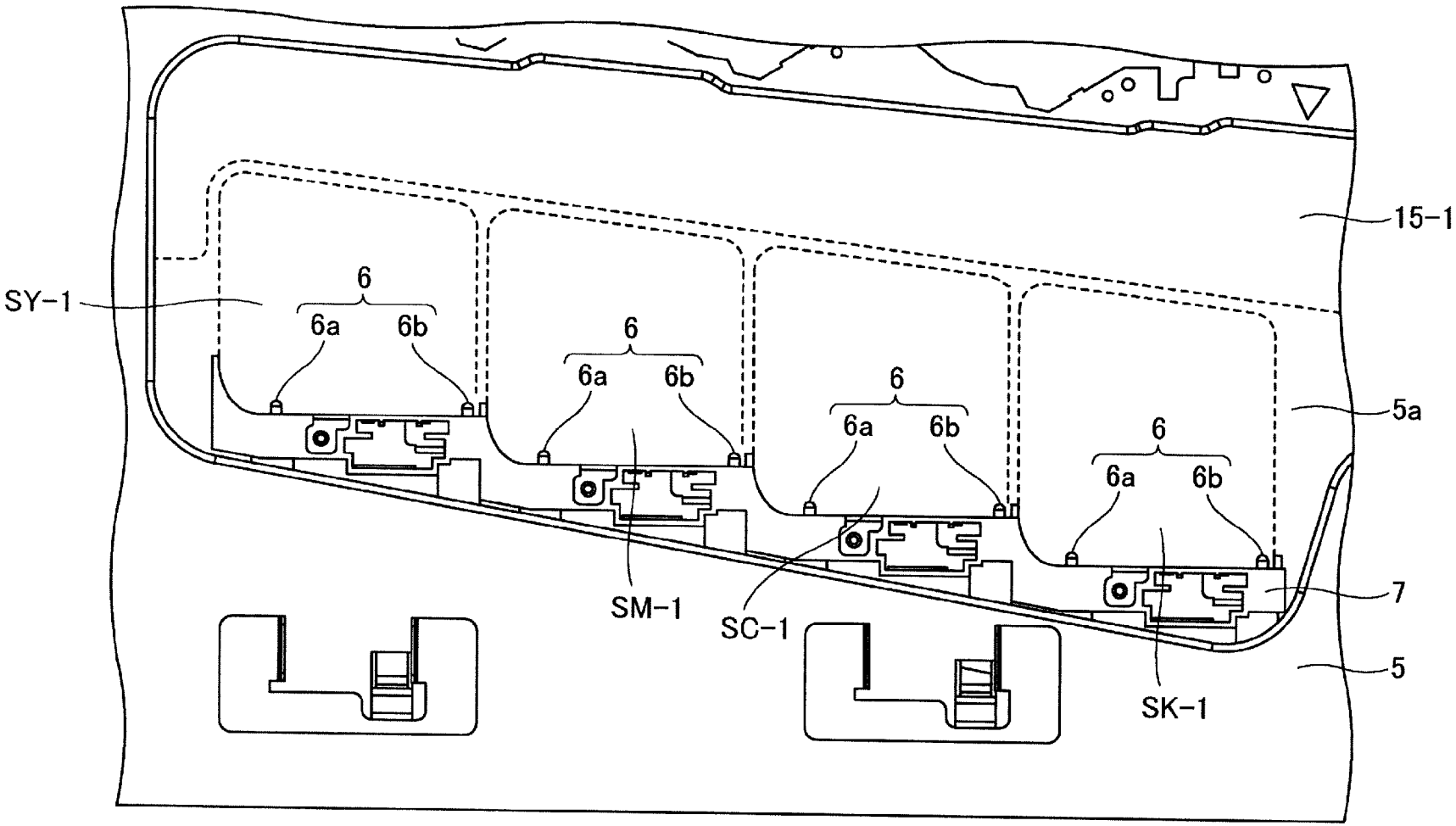
FIG. 4 is a drawing to show the internal structure of the printer in FIG. 1 in a state in which the outer door and the inner door are open and image forming sections are detached.

The intermediate transfer belt 15 put into a unit and the four image forming sections SY, SM, SC, and SK are detachably placed in the cabinet 1 exposed with the outer door 2 open, as shown in FIGS. 1, 3, and 4. In the exemplary embodiment, the placement portions of the four image forming sections SY, SM, SC, and SK in the cabinet 1 differ in order in the up and down direction (in other words, the four image forming sections are provided in a staircase pattern); the image forming section SY is placed at the highest position and the placement portions of the image forming sections SM, SC, and SK are lower in order.

FIG. 3 shows a state in which the intermediate transfer belt 15 and the image forming sections SY, SM, SC, and SK are placed and FIG. 4 shows a state in which they are detached. That is, in FIG. 4, a space 15-1 as a placement portion is provided in the part where the intermediate transfer belt 15 shown in FIG. 3 is placed and spaces SY-1, SM-1, SC-1, and SK-1 as placement portions are provided in the parts where the image forming sections SY, SM, SC, and SK shown in FIG. 3 are placed.

The intermediate transfer belt 15 and the image forming sections SY, SM, SC, and SK are concealed by an inner door (an example of open/closed section, a part of an example of displacement unit) 3 attached to an internal wall 5 formed with an opening 5*a* where the intermediate transfer belt 15 and the image forming sections SY, SM, SC, and SK can be attached and detached, the inner door 3 being opened and closed with a lower part as a support point for closing the opening 5*a* when the inner door is closed, as shown in FIG. 1.

As shown in the drawing, the inner door 3 is provided with two release levers (an example of operation unit) 4 for moving the closed inner door 3 between a position where the inner door 3 is locked to the internal wall 5 and a position where lock with the internal wall 5 is released.

As shown in FIGS. 3 and 4, just below the image forming sections SY, SM, SC, and SK and on the inside to the internal wall 5 (namely, lower part of the rear end in the placement direction of the image forming sections SY, SM, SC, and SK), a support member 7 attached to the cabinet 1 to allow power feed terminals 6 (an example of power feed member) formed of each a conductive member and electrically connected to a power supply (not shown) to appear and disappear toward the upper part (namely, toward the developing devices 12Y, 12M, 12C, and 12K and the charging rollers 11Y, 11M, 11C, and 11K) is placed along the internal wall 5.

The power feed terminals 6 are power feed terminals (an example of power feed member) 6*a* for feeding power into the developing devices 12Y, 12M, 12C, and 12K of the image forming sections SY, SM, SC, and SK placed in the spaces SY-1, SM-1, SC-1, and SK-1 as placement portions and power feed terminals (an example of power feed member) 6*b* for feeding power into the charging rollers 11Y, 11M, 11C, and 11K. Power may be fed at all times (namely, at the operating time and the standby time) or may be fed only at the operating time. This means that power may be fed at least when the apparatus is used.

Each of the power feed terminals 6 is provided so as to be able to move to two positions of a noncontact position (position shown in FIGS. 8 and 14; projection position from the support member 7) where the power feed terminal is out of electrical contact with (electrodes 33 (FIG. 14, 15)) of the developing devices 12Y, 12M, 12C, and 12K and the charging rollers 11Y, 11M, 11C, and 11K and a contact position (position shown in FIGS. 9 and 15; sinking position into the support member 7) where the power feed terminal comes in electrical contact with. When the power feed terminal 6 comes in contact with the electrode 33 of a power-fed body at the contact position, power is fed from the power supply provided in the cabinet 1 into the image forming section as a power-fed body.

The noncontact position of the power feed terminal 6 need not necessarily be a sinking position into the support member 7 and may be any position where the power feed terminal cannot come in contact with the image forming section as the power-fed body (here, the developing device 12Y, 12M, 12C, 12K, the charging roller 11Y, 11M, 11C, 11K) even if it is a projection position.

In the exemplary embodiment, each of the photoconductive drums 10Y, 10M, 10C, and 10K is electrically connected to a ground terminal (not shown) of a power feed terminal. Each of the primary transfer rollers 16Y, 16M, 16C, and 16K fits into a power feed terminal (not shown) provided ahead in the placement direction of the intermediate transfer belt 15 and is electrically connected. However, power may be fed through the power feed terminals 6 into the photoconductive drums 10Y, 10M, 10C, and 10K and the primary transfer rollers 16Y, 16M, 16C, and 16K. This means that power may be fed through the power feed terminal 6 into at least any of the photoconductive drum 10Y, 10M, 10C, 10K, the charging roller 11Y, 11M, 11C, 11K, the developing device 12Y, 12M, 12C, 12K, the primary transfer roller 16Y, 16M, 16C, 16K.

Figure 5:
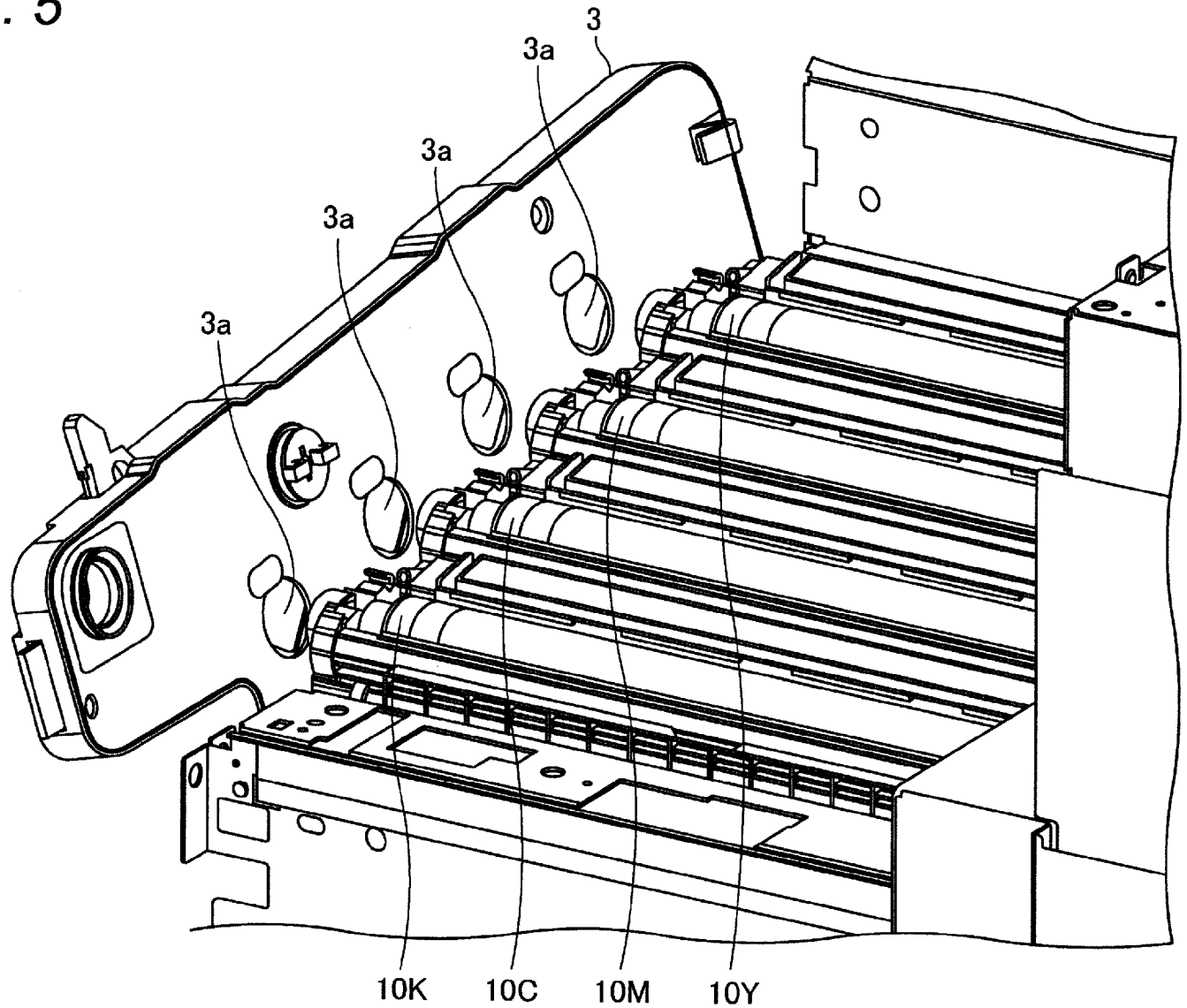
FIG. 5 is a perspective view to show the relationship between a photoconductive drum and the inner door in the printer in FIG. 1.

As shown in FIG. 5, the photoconductive drums 10Y, 10M, 10C, and 10K, the charging rollers 11Y, 11M, 11C, and 11K, the developing devices 12Y, 12M, 12C, and 12K, and the primary transfer rollers 16Y, 16M, 16C, and 16K are placed with the longitudinal direction pointed toward the same direction as the placement direction in which they are placed in the spaces SY-1, SM-1, SC-1, and SK-1 as placement portions, and transmission unit (gear, coupling, etc.) for transmitting a rotation force to the photoconductive drums 10Y, 10M, 10C, and 10K, the charging rollers 11Y, 11M, 11C, and 11K, the developing devices 12Y, 12M, 12C, and 12K, and the primary transfer rollers 16Y, 16M, 16C, and 16K is placed ahead in the placement direction of the image forming sections as power-fed bodies.

The power feed terminals 6 come in contact with (the electrodes 33 provided on) a side face different from the front and the back in the placement direction of the image forming sections as power-fed bodies (here, the charging roller 11Y, 11M, 11C, 11K, the developing device 12Y, 12M, 12C, 12K).

Thus, contact areas with the power feed terminals 6 (namely, the electrodes 33) are placed on the side face having a large area as compared with the front and the back of the image forming sections as power-fed bodies.

Figure 6:
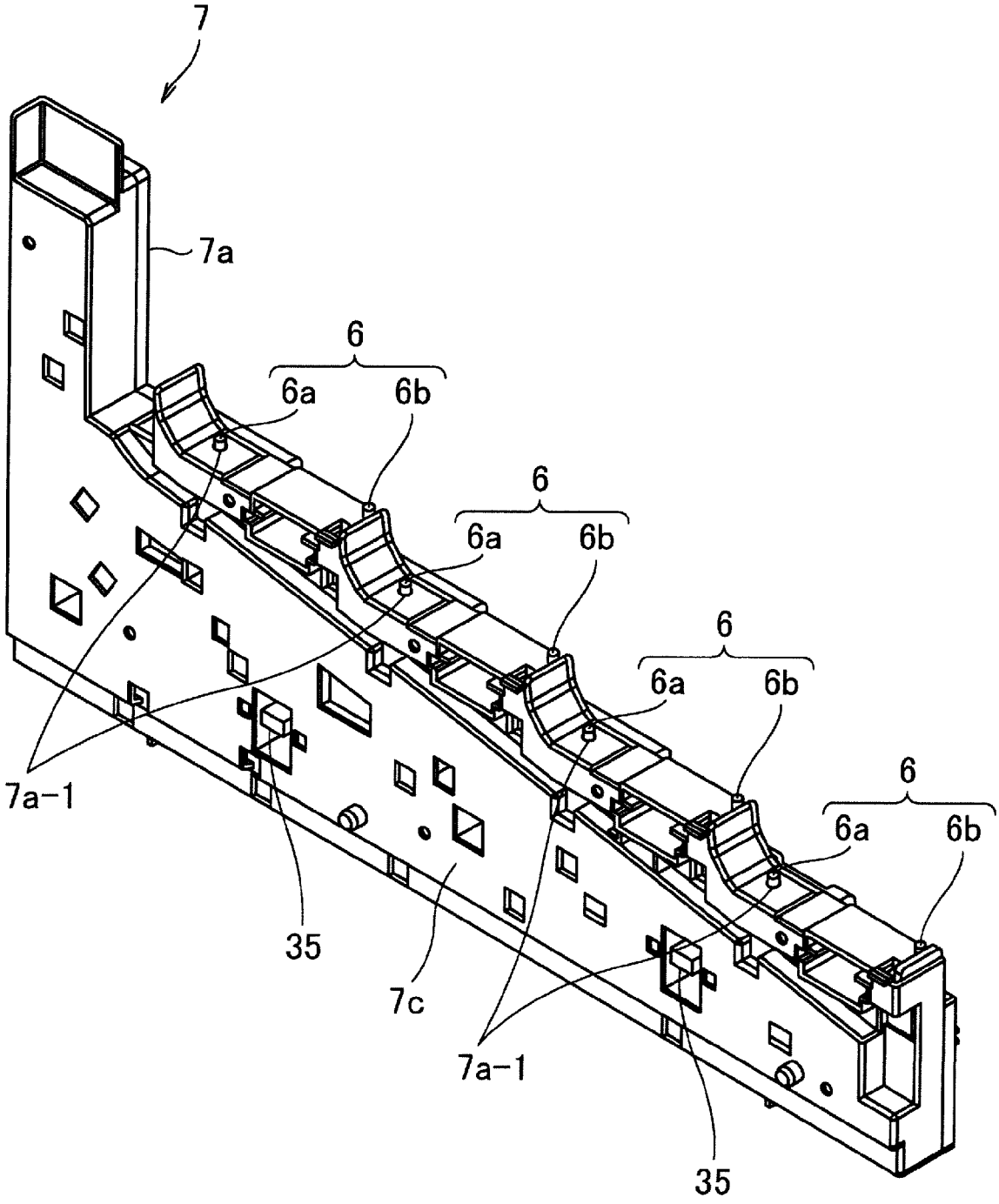
FIG. 6 is a perspective view to show a support member placed in the printer in FIG. 1.
Figure 7:
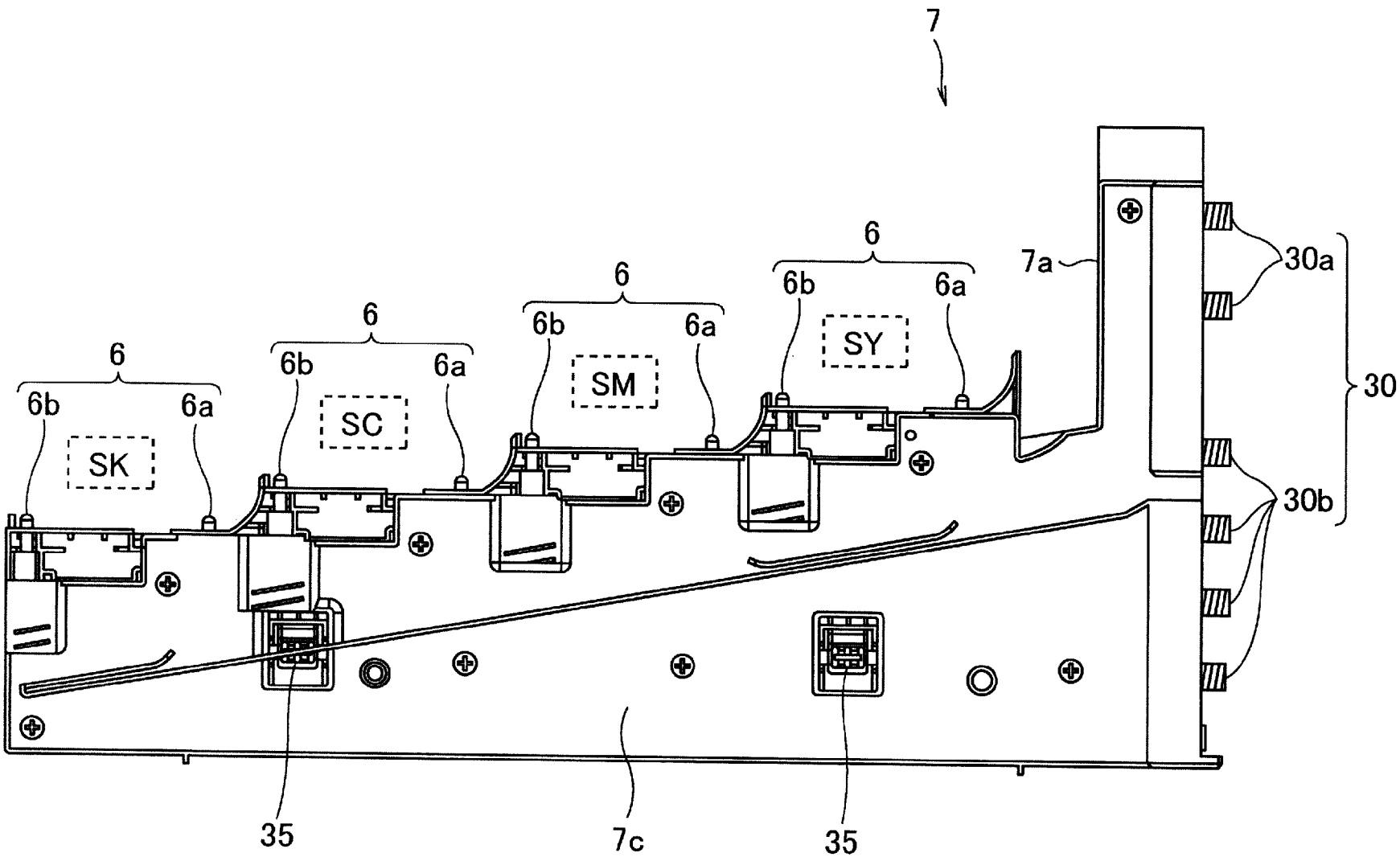
FIG. 7 is a rear view of the support member in FIG. 6.

As shown in FIGS. 6 and 7, the support member 7 is formed on the top with four steps matched with the spaces as the placement portions of the four image forming sections SY, SM, SC, and SK in the cabinet 1. The power feed terminals 6*a* and the power feed terminals 6*b* appearing and disappearing from holes 7*a*-1 formed in the top faces are placed as they mutually slightly differ in positions in the thickness direction.

Figure 8:
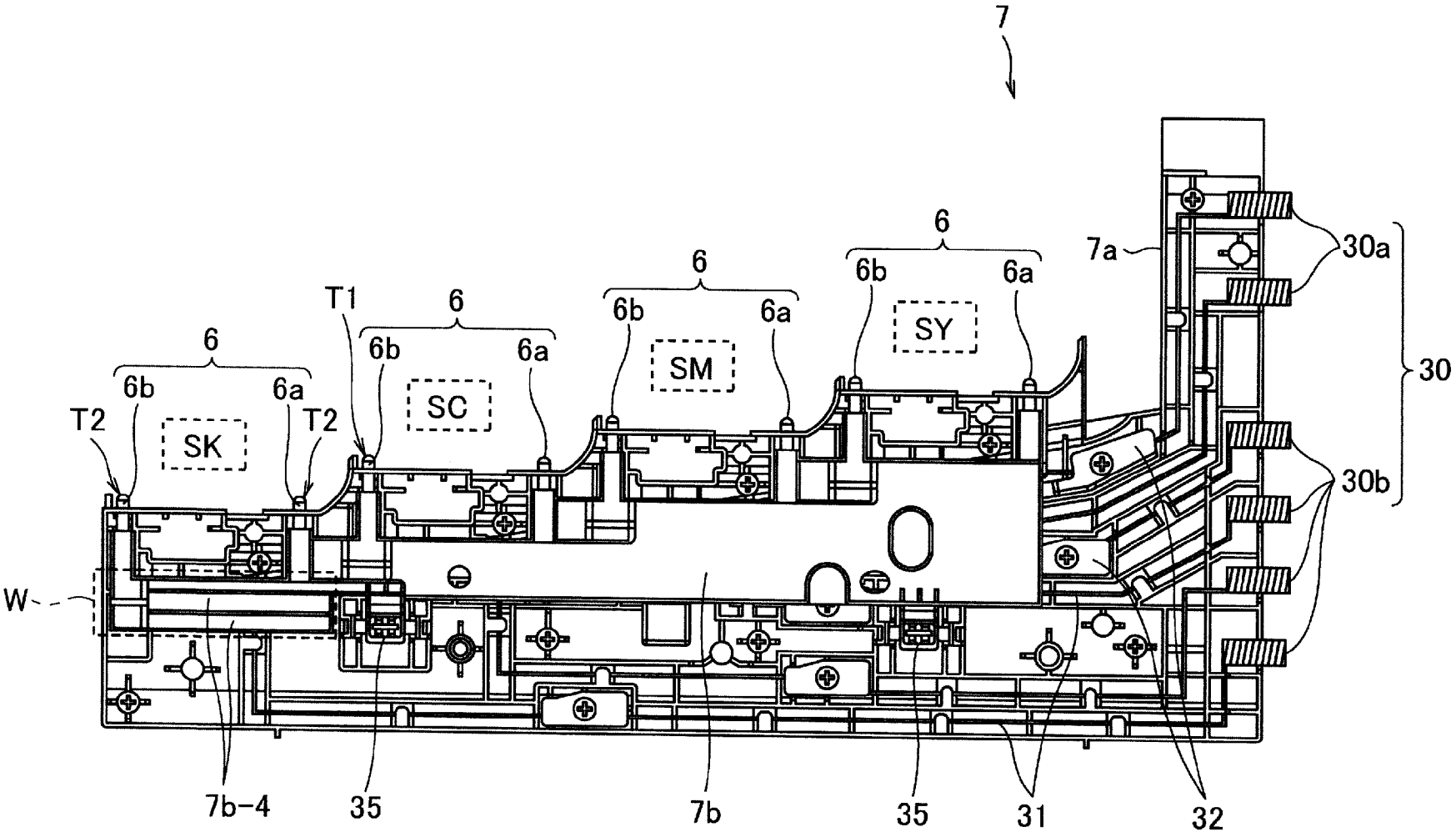
FIG. 8 is a drawing to show a state in which each power feed terminal is at a contact position with a protection plate removed in the support member in FIG. 6.
Figure 9:
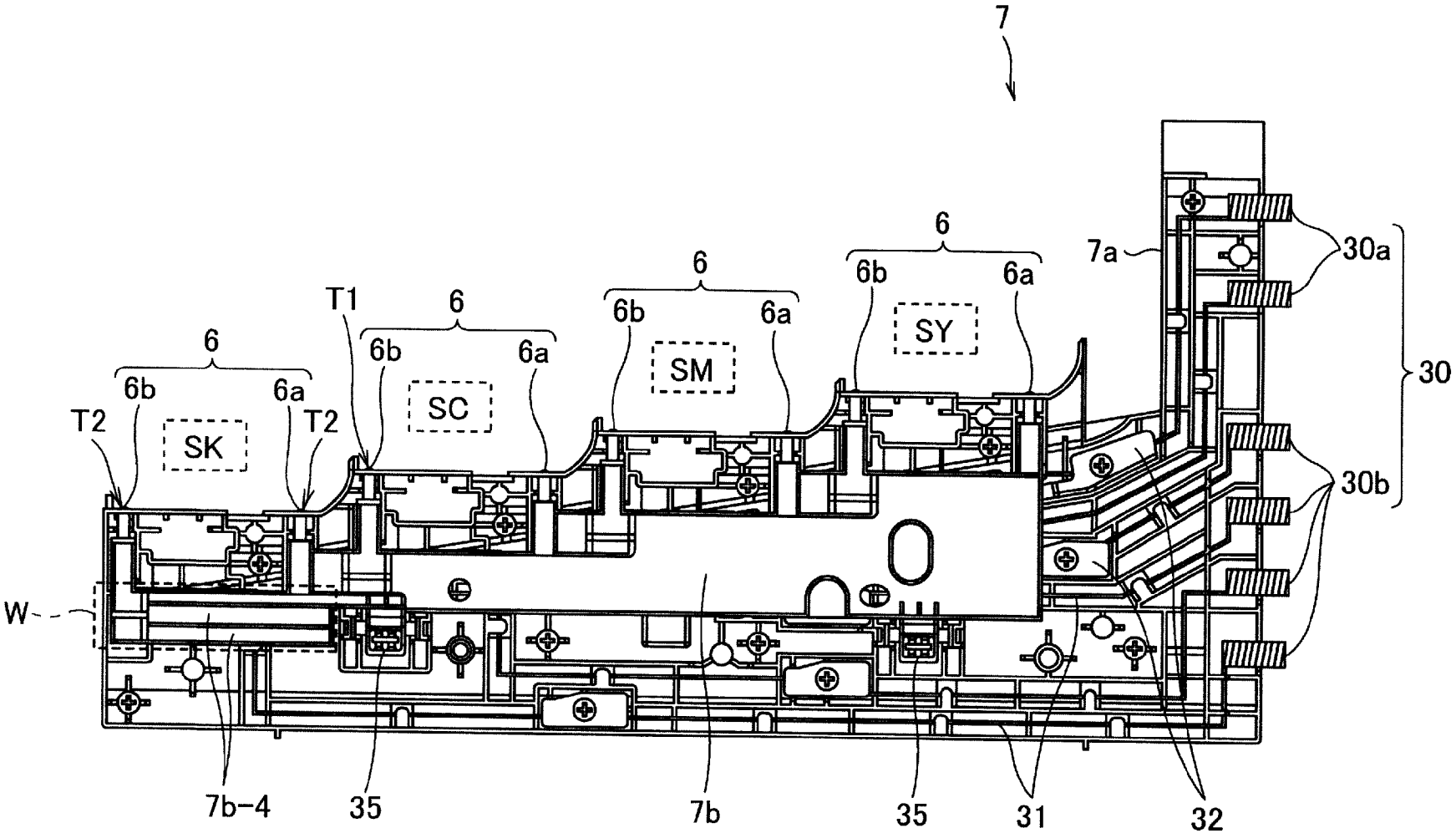
FIG. 9 is a drawing to show a state in which each power feed terminal is at a noncontact position with the protection plate removed in the support member in FIG. 6.

As shown in FIGS. 8 and 9, the support member 7 includes a main part 7*a* formed with the holes 7*a*-1 where the power feed terminals 6 appear and disappear in the up and down direction and a move plate (an example of displacement section, a part of an example of displacement unit) 7*b* attached movably in the up and down direction along one side face of the main part 7*a*. A wire 31 having one end connected to the power feed terminals 6 and an opposite end to which conductive coil springs 30 are attached is fitted into the main part 7*a* from the attachment side of the move plate 7*b* and is routed in the main part 7*a*. The move plate 7*b* is formed of a nonconductive member of a resin, etc., for example.

Six coil springs 30 are placed in one row along the up and down direction at one end of the main part 7*a*. When the support member 7 is placed in the cabinet 1, the coil springs 30 are brought into press-contact with terminals from the power supply provided in the cabinet 1 by a spring force. In the exemplary embodiment, two upper coil springs 30*a* are connected to the power feed terminals 6*a* for feeding power into the developing devices 12Y, 12M, 12C, and 12K through the wire 31 and four lower coil springs 30*b* are connected to the power feed terminals 6*b* for feeding power into the charging rollers 11Y, 11M, 11C, and 11K through the wire 31. Of the two upper coil springs 30*a*, the upper coil spring 30*a* is used to feed power into the developing devices 12Y, 12M, and 12C of the image forming sections SY, SM, and SC, and the lower coil spring 30*a* is used to feed power into the developing device 12K of the image forming section SK.

Figure 10:
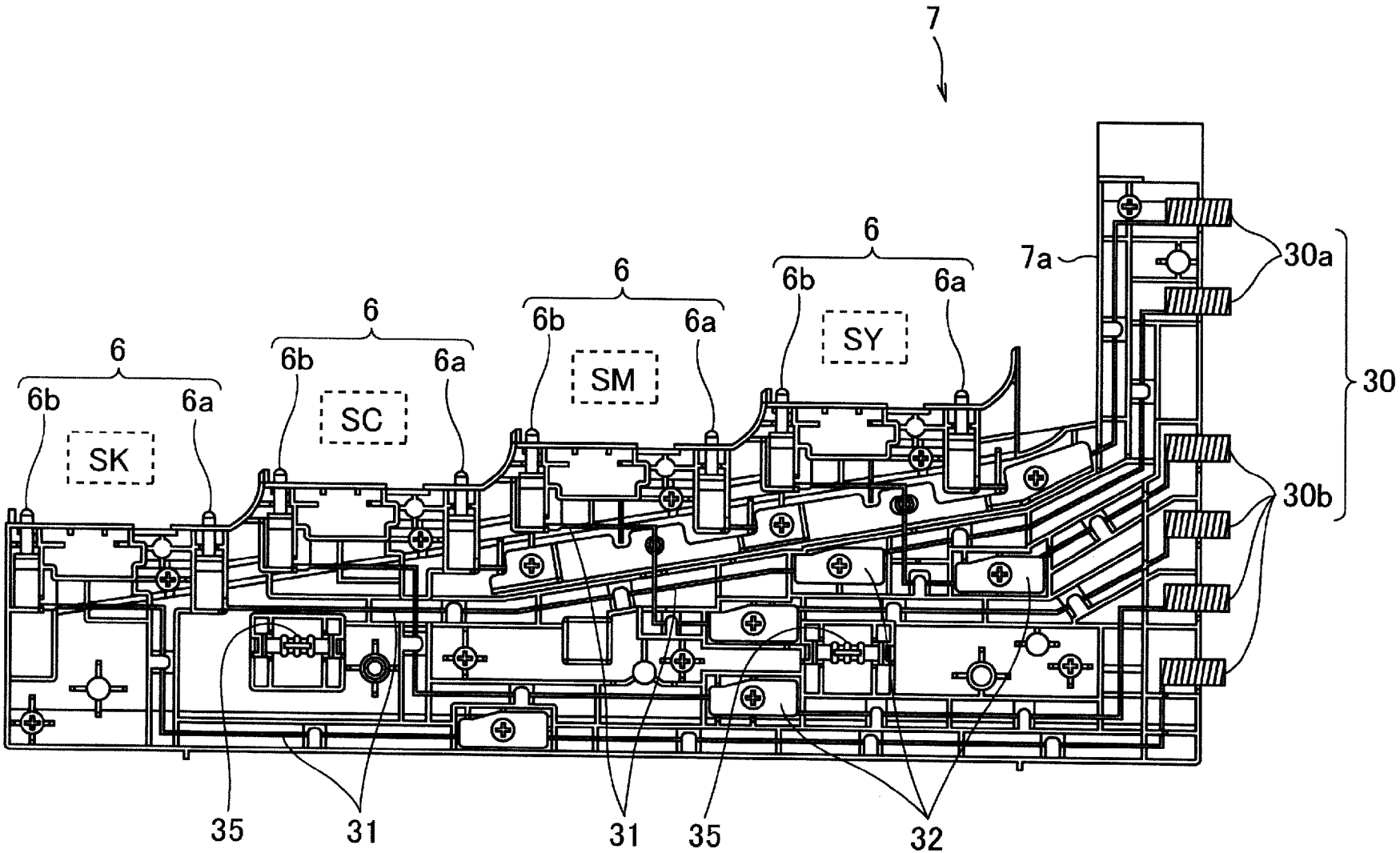
FIG. 10 is a drawing to show a state in which each power feed terminal is at the contact position with a move plate and the protection plate removed in the support member in FIG. 6.

In FIG. 10 to show the internal structure of the support member in a state in which the move plate 7*b* is removed, the wire 31 is pressed against the main part 7*a* appropriately by a conduction plate 32 and is prevented from dropping off from the main part 7*a*.

The support member 7 further has a protection plate 7*c* for preventing the move plate 7*b* from dropping off from the main part 7*a* and also preventing the wire 31 and the conduction plate 32 becoming a high voltage from being exposed. The protection plate 7*c* is attached covering the attachment face of the main part 7*a* on the move plate 7*b* side (FIGS. 6 and 7).

Figure 11:
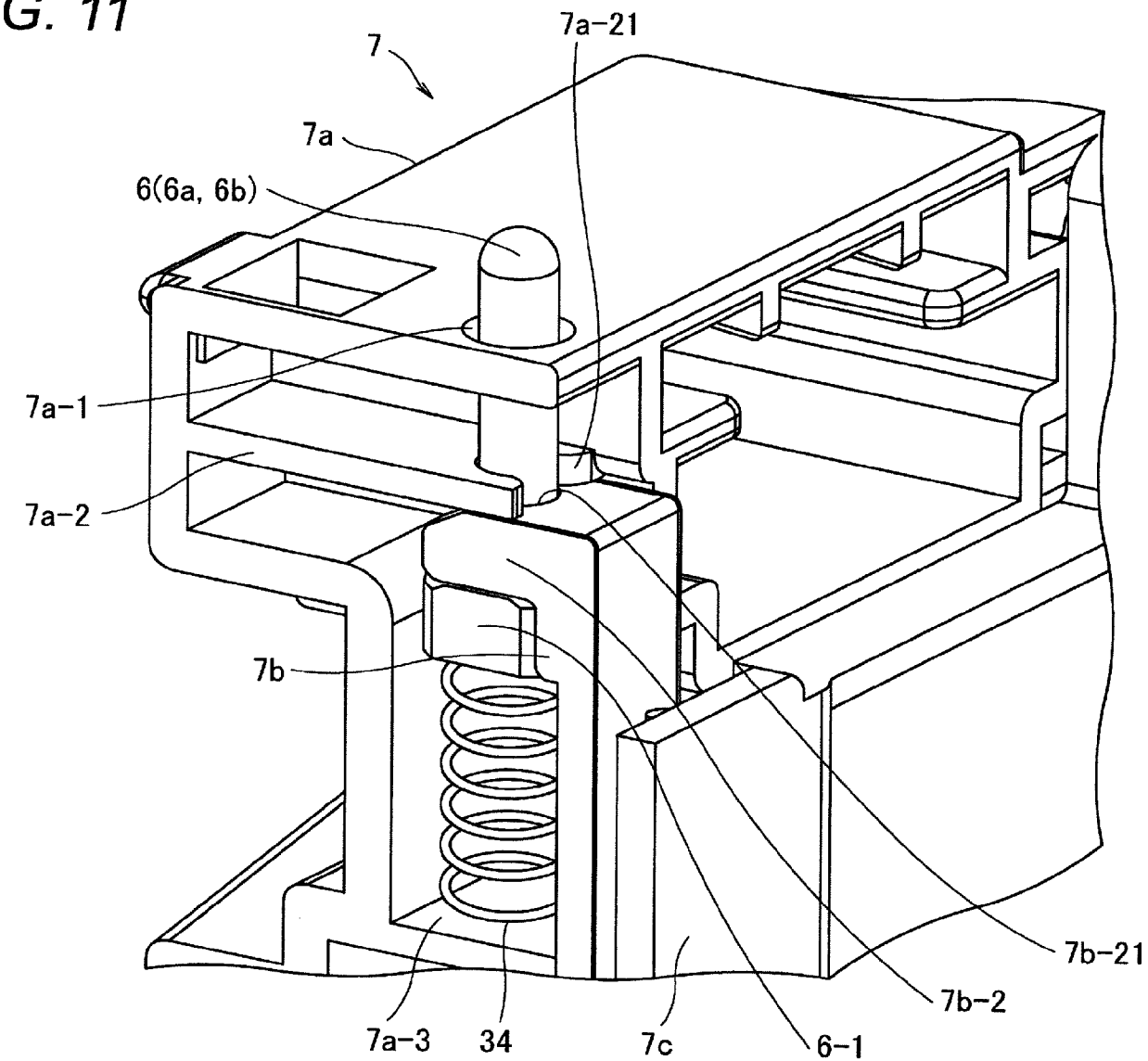
FIG. 11 is a perspective view to show the attachment structure of the power feed terminals to the support member.

As shown in FIG. 11, just below each of the holes 7*a*-1, a main part side retaining piece 7*a*-2 provided with a notch 7*a*-21 into which the power feed terminal 6 is fitted from a side, the notch 7*a*-21 being provided at a position corresponding to the hole 7*a*-1, is formed having a spacing from the hole 7*a*-1. Further, a pedestal part 7*a*-3 is provided below the notch 7*a*-21 of the main part side retaining piece 7*a*-2.

Figure 12:
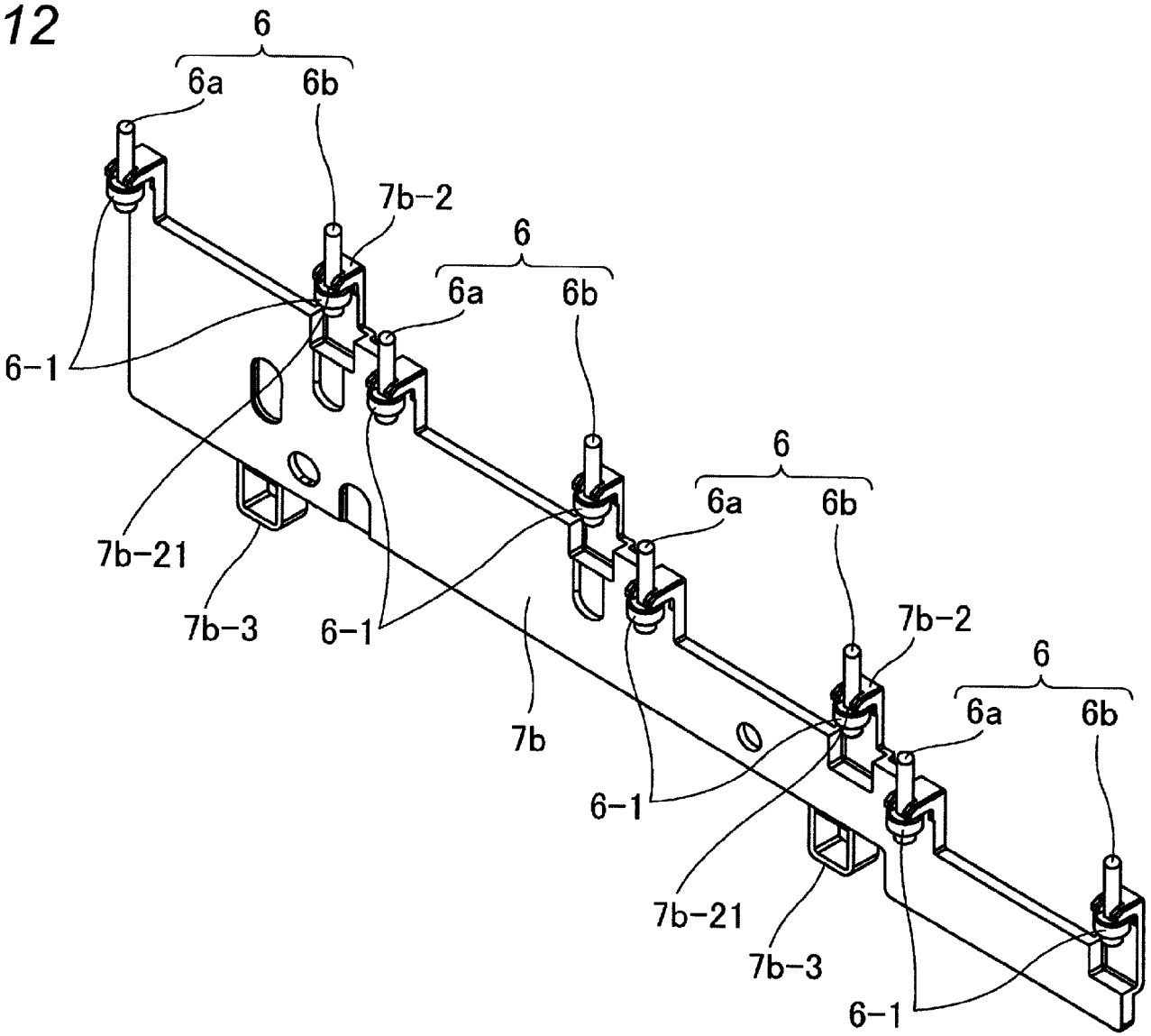
FIG. 12 is a perspective view to show the relationship between the power feed terminals and the move plate.

The move plate 7*b* is provided with a plate side retaining piece 7*b*-2 provided with a notch 7*b*-21 into which the power feed terminal 6 is fitted from an opposite direction to the main part side retaining piece 7*a*-2 so that the plate side retaining piece 7*b*-2 can be brought into or out of contact with the lower face of the main part side retaining piece 7*a*-2 with a move of the move plate 7*b*. The plate side retaining piece 7*b*-2 is put on a base part 6-1 of the power feed terminal 6 from above (see FIG. 12). Therefore, when the move plate 7*b* moves down from the position shown in the figure, the power feed terminal 6 sinks into the support member 7 as it is retained by the hole 7*a*-1 and the two notches 7*a*-21 and 7*b*-21, and is placed at the noncontact position where the power feed terminal 6 does not come in electrical contact with the image forming section as the power-fed body.

A coil spring (an example of urging unit) 34 is fitted between the bottom face of the power feed terminal 6 and the pedestal part 7*a*-3 provided in the main part 7*a*. The coil spring 34 is fitted in a compressed state. Therefore, when the move plate 7*b* is placed at a move-up position (first position) by the spring force (urging force) of the coil spring 34, the power feed terminal 6 is placed at a contact position (position shown in FIG. 11) where it comes in electrical contact with the developing device 12Y, 12M, 12C, 12K and (the electrode 33 of) the charging roller 11Y, 11M, 11C, 11K each forming a part of the image forming section as the power-fed body. When the move plate 7*b* is placed at a move-down position (second position) as described above against the spring force of the coil spring 34, the eight power feed terminals 6 moved collectively by the move plate 7*b* are placed each at a noncontact position where the power feed terminal 6 does not come in electrical contact with the image forming section as the power-fed body.

Thus, when each coil spring 34 serves as both a unit for urging the power feed terminal 6 to the contact position and a unit for producing a pressure for moving the move plate 7*b*, the number of components is reduced and a fruitless space does not occur as compared with the case where separate unit are provided.

Figure 13:
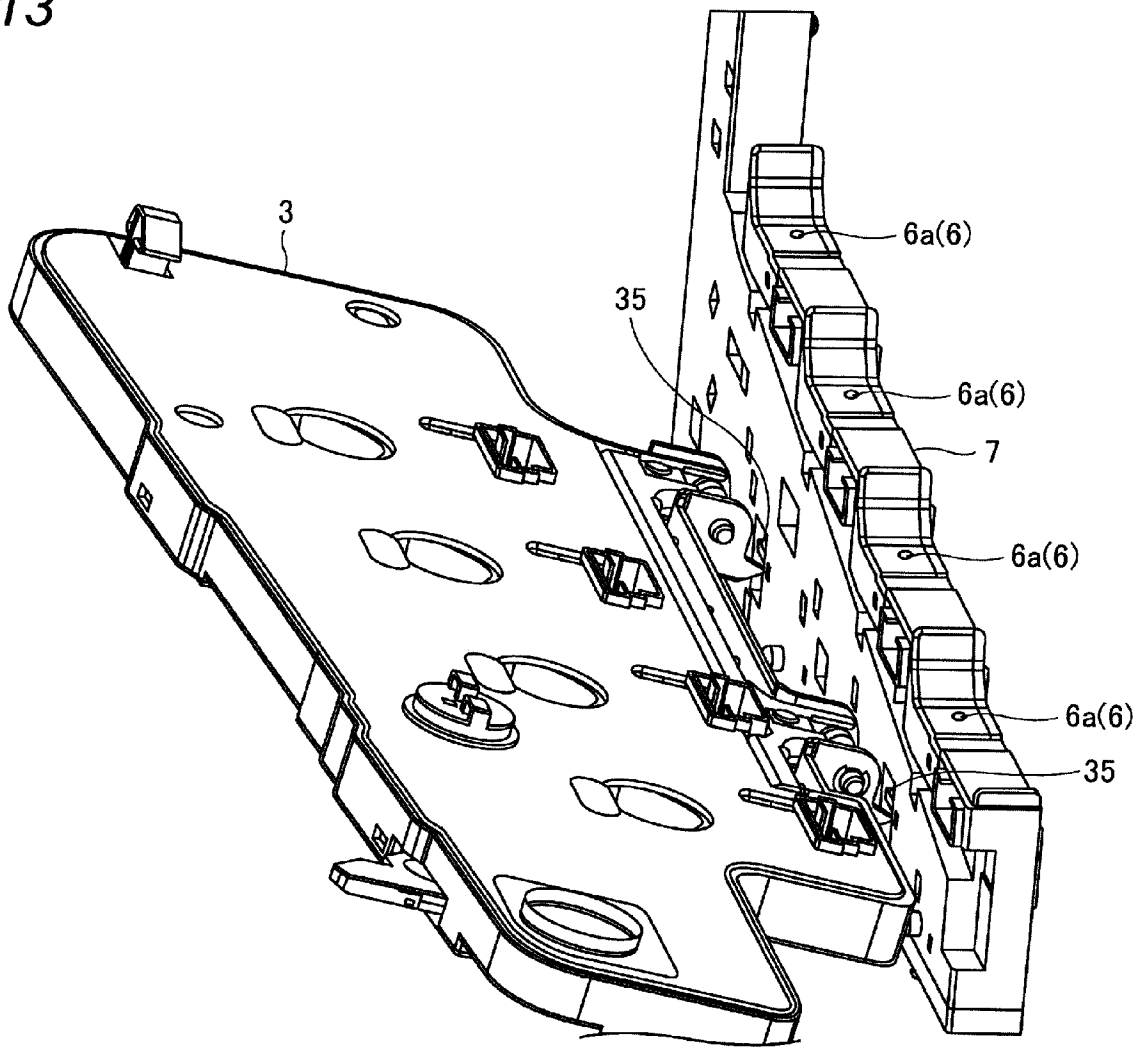
FIG. 13 is a perspective view to show the relationship between the support member and the inner door.

Two opening projections 7*b*-3 are formed on the bottom of the move plate 7*b*. Rocking pins (each a part of an example of move section and displacement unit) 35 fitted on one side into the opening projections 7*b*-3 and on an opposite side interfering with the inner door 3 and rocking by the opening/closing operation of the inner door 3 are attached to the support member 7 and are placed between the move plate 7*b* and the inner door 3 (see FIG. 13).

Move unit is made up of displacement unit made up of the move plate 7*b*, the inner door 3, and the rocking pins 35 and the coil springs 34.

When the inner door 3 is closed, interfering of the rocking pins 35 with the inner door 3 is released, the side of the rocking pins 35 fitted into the opening projections 7*b*-3 becomes the upper side, and the opposite side of the rocking pins 35 (inner door 3 side) becomes the lower side. When the inner door 3 is open, the rocking pins 35 interfere with the inner door 3, the side of the rocking pins 35 fitted into the opening projections 7*b*-3 becomes the lower side, and the opposite side of the rocking pins 35 (inner door 3 side) becomes the upper side.

Figure 14:
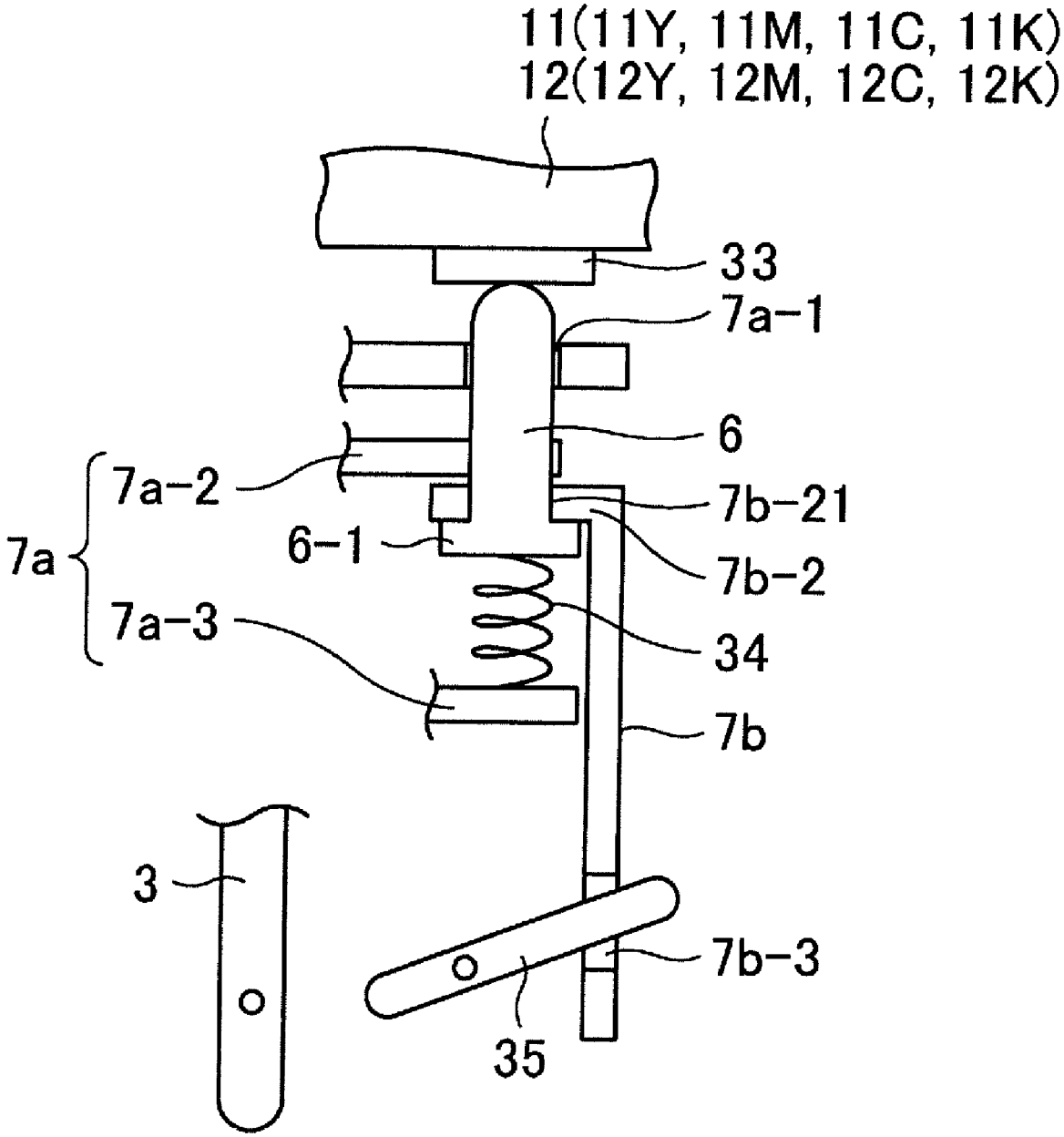
FIG. 14 is a schematic representation to show a state in which the power feed terminal is at the contact position with the image forming section.

Therefore, as shown in FIG. 14, when the inner door 3 is closed, the move plate 7*b* with the rocking pins 35 fitted into the opening projections 7*b*-3 is placed at the move-up position by the spring force of the coil springs 34 and the power feed terminals 6 are placed at the contact position where they come in contact with the image forming sections as the power-fed bodies.

Figure 15:
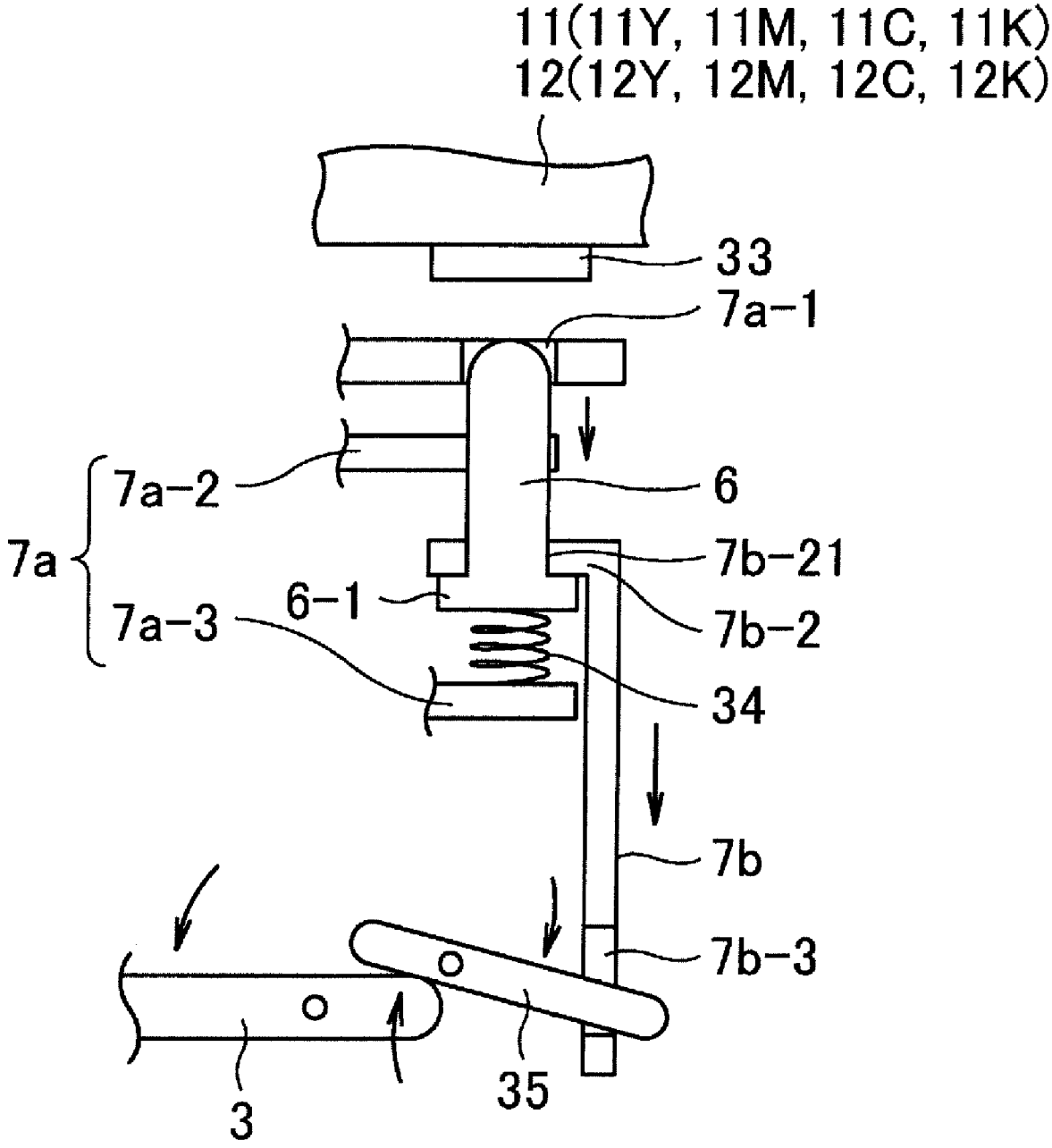
FIG. 15 is a schematic representation to show a state in which the power feed terminal is at the noncontact position with the image forming section.

As shown in FIG. 15, when the inner door 3 is open, the side of the rocking pins 35 interfering with the inner door 3, fitted into the opening projections 7*b*-3 becomes the lower side and the opposite side of the rocking pins 35 (inner door 3 side) becomes the upper side. Accordingly, the move plate 7*b* is placed at the move-down position against the spring force of the coil springs 34 and the power feed terminals 6 are placed at the noncontact position where they do not come in contact with the image forming sections as the power-fed bodies.

Thus, each of the power feed terminals 6 is moved between the contact position and the noncontact position with the image forming section as the power-fed body in operative association with opening/closing of the inner door 3. Therefore, when the inner door 3 is opened to attach or detach the developing devices 12Y, 12M, 12C, and 12K and the charging rollers 11Y, 11M, 11C, and 11K, the power feed terminals 6 are placed at the noncontact position and when attaching or detaching work is complete and the inner door 3 is closed, the power feed terminals 6 are placed at the contact position.

In the exemplary embodiment, the balance between the spring pressure of the coil springs 34 and the weight of the inner door 3 is set, whereby the coil springs 34 function as a damper for the inner door 3 when the inner door 3 is opened.

Here, each of the power feed terminals 6 is moved between the contact position and the noncontact position with the image forming section as the power-fed body in operative association with opening/closing of the inner door 3, but may be moved in operative association with the outer door 2. Further, a structure wherein each of the power feed terminals 6 is moved using a manual lever or a structure wherein each of the power feed terminals 6 is moved in operative association with the placing operation of the image forming section in the corresponding space as the placement portion may be adopted without operative association with the inner door 3 or the outer door 2.

In the exemplary embodiment, in FIG. 5, the inner door 3 for moving the power feed terminals 6 is formed with V grooves (an example of positioning portion) 3*a* for positioning the photoconductive drums 10Y, 10M, 10C, and 10K. The portions for positioning the photoconductive drums 10Y, 10M, 10C, and 10K need not be the V grooves and may be of any shape if the photoconductive drums 10Y, 10M, 10C, and 10K can be positioned.

The release lever 4 provided in the inner door 3 is provided with a press mechanism (not shown) for pressing the photoconductive drums 10Y, 10M, 10C, and 10K against the V grooves 3*a* in operative association with the rotation operation of the release lever 4 when the release lever 4 is rotated.

When the power feed terminals 6 are brought into contact with the image forming sections as the power-fed bodies in operative association with the operation of closing the inner door 3, the power feed terminals 6 operatively associated with opening/closing of the inner door 3 lift up the photoconductive drums 10Y, 10M, 10C, and 10K to positions in a noncontact state with the V grooves 3*a*. Therefore, when the inner door 3 is closed, the photoconductive drums 10Y, 10M, 10C, and 10K and the V grooves 3*a* are in a noncontact state; the release lever is rotated for the press mechanism to press the photoconductive drums 10Y, 10M, 10C, and 10K against the V grooves 3*a*, whereby the photoconductive drums 10Y, 10M, 10C, and 10K are positioned.

Accordingly, when the inner door 3 is closed, shaving of the V grooves 3*a* of the positioning parts of the photoconductive drums 10Y, 10M, 10C, and 10K is prevented. Therefore, a positioning shift from a sheet of paper P and a color shift in color print caused by shaving of the V grooves 3*a* are eliminated. The power feed terminals 6 act so as to lift up the image forming sections as the power-fed bodies and then the photoconductive drums 10Y, 10M, 10C, and 10K are pushed down using the release lever 4, so that connection of the contacts is more ensured.

In the exemplary embodiment in which the image forming sections as the power-fed bodies are provided so that the spaces as the placement portions in the cabinet 1 differ in order in the up and down direction, as shown in detail in FIGS. 8 and 9, the rotation shaft of the inner door 3 for moving the move plate 7*b* is placed so as to become horizontal and thus one side of the move plate 7*b* (the left of the drawing) is low (thin) and an opposite side (the right of the drawing) is high (thick). Thus, the one side of the move plate 7*b* (the left of the drawing) has weak rigidity and if an attempt is made to move down the power feed terminals 6 by the move plate 7*b*, it is considered that the power feed terminals 6 do not sufficiently move down and remain at the contact position (move-down trouble of the power feed terminals 6).

In the move plate 7*b* of the exemplary embodiment provided so as to move the eight power feed terminals 6 collectively between the move-up position and the move-down position, the position driven by the rocking pin 35 is to the right of the drawing where rigidity is strong and thus rigidity becomes relatively weaker on the drawing left of the move plate 7*b* and move-down trouble of the power feed terminals 6 is still more feared. The reason why the position is to the right of the drawing is that since a high pressure is applied to the power feed terminals 6 and the part corresponding to the rocking pin 35 of the move plate 7*b* is an opening where a conductor of a plate, etc., is exposed, creepage distance and air clearance are ensured to exclude the risk of a short circuit.

Then, as shown in FIGS. 8 and 9, in the move plate 7*b*, a part W for moving the power feed terminal 6 (the power feed terminal 6 indicated by symbol T2) positioned below the power feed terminal 6 (the power feed terminal 6 indicated by symbol T1) at a position where the rocking pin 35 abuts has a lower end part made lower than any other part. The part W is formed with a larger number of reinforcement projections 7*b*-4 extending in a lateral direction than any other part.

Accordingly, a relative rigidity reduction of the part W for moving the power feed terminal 6 (T2) positioned below the power feed terminal 6 (T1) at the position where the rocking pin 35 abuts can be prevented. If the lower end part of the part W is formed as in the exemplary embodiment, the power feed terminal 6 is reliably moved to the two positions as compared with the case where the lower end parts are formed linearly when viewed in the horizontal direction. Further, if the reinforcement projections 7*b*-4 are formed as in the exemplary embodiment, the power feed terminal 6 is reliably moved to the two positions as compared with the case where the reinforcement projections are formed uniformly. Only either of the structure wherein the lower end part of the part W is made lower than that of any other part and the structure wherein the part W is formed with a larger number of reinforcement projections 7*b*-4 than any other part may be adopted.

In a structure wherein each power feed terminal provided in the apparatus main body of a cabinet, etc., always projects to the space to place or detach each image forming section as a power-fed body and is fixed and when the image forming section as a power-fed body is placed, the power feed terminal and the image forming section as a power-fed body rub against each other, as they rub against each other, it is feared that a flaw or a bend may occur on the power feed terminal, causing a power feed failure to occur. It is also feared that rust may occur depending on the situation at high humidities.

If a power feed failure occurs, namely, if contacts are brought away from each other, no power is fed into the image forming section as a power-fed body and it becomes impossible to form an image. If power feed becomes unstable because contact is unstable although contacts touch each other (contact is made), it is feared that unevenness of image density caused by voltage fluctuation may occur.

In a structure wherein each power feed terminal provided in the apparatus main body always projects to the placement space to place or detach each image forming section as a power-fed body and when the image forming section as a power-fed body is placed, the power feed terminal and the image forming section as a power-fed body are at a distance from each other and do not rub against each other and after the image forming section as a power-fed body is placed to the depth of the space as the placement portion, it moves down and the power feed terminal and the image forming section as a power-fed body come in contact with each other, it becomes necessary to form the image forming section as a power-fed body with a relief part to circumvent interfering with the power feed terminal projecting along the placement direction of placing the image forming section as a power-fed body. Since the relief part extends long over the placement direction of the image forming section as a power-fed body, other parts must be placed avoiding the relief part and flexibility of design is limited. Particularly, for a printer that can also be used as a desktop type whose miniaturization is strongly demanded, layout flexibility is remarkably limited.

Further, in a structure wherein each image forming section as a power-fed body is provided with a moving member such as a shutter for opening and closing a toner discharge section or a toner supply section and each power feed terminal provided in the apparatus main body always projects to the placement space for the image forming section as a power-fed body, the image forming section as a power-fed body must be placed at a position where it does not interfere with the moving member so as to prevent the moving member from moving at an unintended point as the image forming section as a power-fed body and the moving member abut against each other (particularly, so as to prevent toner leakage or scattering from occurring as the shutter is opened if the moving member is a shutter).

In contrast, in the power feeding mechanism of the exemplary embodiment, each of the power feed terminals 6 is provided so as to be able to move between the two positions of the noncontact position (see FIG. 8, FIG. 14) where the power feed terminal 6 does not come in electric contact with the image forming section as a power-fed body (here, the developing device 12Y, 12M, 12C, 12K, the charging roller 11Y, 11M, 11C, 11K) and the contact position (see FIG. 9, FIG. 15) where they come in electric contact with each other and when the power feed terminal 6 comes in contact with the electrode 33 of the image forming section as a power-fed body at the contact position, power is fed into the image forming section as a power-fed body. Interfering with the power feed terminal 6 in placing or detaching the image forming section as a power-fed body is prevented as each of the power feed terminals 6 is moved between the contact position and the noncontact position by the move unit (made up of the displacement unit made up of the move plate 7*b*, the inner door 3, and the rocking pins 35 and the coil springs 34).

Therefore, the stability of the contact between each of the power feed terminals 6 and each of the image forming sections as power-fed bodies is ensured and the placement flexibility of the contacts (electrodes 33) improves as compared with the case where each power feed terminal 6 provided in the apparatus main body is fixed to the contact position where it always comes in contact with the image forming section as a power-fed body.

The power feeding mechanism is used with an image forming apparatus such as the printer PR1, whereby unevenness of image density caused by a power feed failure is decreased and the placement flexibility of the contacts (electrodes 33) improves as compared with the case where each power feed terminal 6 provided in the apparatus main body is fixed to the contact position where it always comes in contact with the image forming section as a power-fed body.

In the description given above, the case where the power feeding mechanism of the invention is applied to a toner record printer of an example as an image forming apparatus is shown; however, the power feeding mechanism can also be applied to any other type of image forming apparatus, such as an ink jet image forming apparatus for recording in ejected ink, for example.

Further, the power feeding mechanism of the invention can be applied not only to an image forming apparatus, but also to various apparatus each including an image forming section as a detachable power-fed body receiving power fed from a power supply.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A power feeding mechanism comprising:

a power-fed body that is placed in an apparatus main body, the power-fed body into which power is fed at least when the power-fed body is used;

a placement portion where the power-fed body provided in the apparatus main body is placed;

a power feed member that is provided in the apparatus main body and is configured to move between a noncontact position and a contact position, the power feed member at the contact position feeds power into the power-fed body from the apparatus main body;

a move unit that moves the power feed member to at least the noncontact position and the contact position, wherein at the noncontact position, the power feed member is not in electric contact with the power-fed body being placed in the placement portion, and at the contact position, the power feed member is in electric contact with the power-fed body being placed in the placement portion;

a photoconductive body;

a charging unit that charges the photoconductive body;

a latent image forming unit that forms a latent image on the charged photoconductive body;

a developing unit that develops so as to visualize the latent image formed on the photoconductive body; and a transfer unit that transfers the visible image provided by the developing unit to an intermediate body or a record medium, and wherein the power-fed body contains at least one of the photoconductive body, the charging unit, the developing unit, and the transfer unit, and the power feed member feeds power into the at least one of the photoconductive body, the charging unit, the developing unit and the transfer unit, wherein a longitudinal direction of the photoconductive body, the charging unit, or the developing unit is the same as a placement direction in which the power-fed body is placed in the placement portion, the image forming apparatus further comprises a transmission unit that transmits a rotation force to the photoconductive body, the charging unit, or the developing unit, the transmission unit is placed ahead in the placement direction of the power-fed body, and the power feed member is placed to come in contact with a side face different from the front and the back of the power-fed body in the placement direction.

2. The image forming apparatus according to claim 1, wherein the move unit includes:

an urging unit that urges the power feed member to the contact position with the power-fed body; and a displacement unit that displaces the power feed member to the noncontact position with the power-fed body against the urging force of the urging unit.

3. The image forming apparatus according to claim 2 wherein the displacement unit includes:

a displacement section that is configured to be displaced to a first position and a second position, wherein the first position corresponds to a position when the power feed member is placed at the contact position as urged by the urging unit, and the second position corresponds to a position when the power feed member is placed at the noncontact position against the urging unit;

a move section that abuts the displacement section and moves the displacement section between the first position and the second position; and an open/closed section being opened or closed when the power-fed body is placed or detached, the open/closed section places the displacement section at the first position through the move section when the open/closed section is closed, and the open/closed section places the displacement section at the second position through the move section when the open/closed section is opened.

4. A power feeding mechanism comprising:

a power-fed body that is placed in an apparatus main body, the power-fed body into which power is fed at least when the power-fed body is used;

a placement portion where the power-fed body provided in the apparatus main body is placed;

a power feed member that is provided in the apparatus main body and is configured to move between a noncontact position and a contact position, the power feed member at the contact position feeds power into the power-fed body from the apparatus main body;

a move unit that moves the power feed member to at least the noncontact position and the contact position, wherein at the noncontact position, the power feed member is not in electric contact with the power-fed body being placed in the placement portion, and at the contact position, the power feed member is in electric contact with the power-fed body being placed in the placement portion;

a photoconductive body;

a charging unit that charges the photoconductive body;

a latent image forming unit that forms a latent image on the charged photoconductive body;

a developing unit that develops so as to visualize the latent image formed on the photoconductive body; and a transfer unit that transfers the visible image provided by the developing unit to an intermediate body or a record medium, and wherein the power-fed body contains at least one of the photoconductive body, the charging unit, the developing unit, and the transfer unit, and the power feed member feeds power into the at least one of the photoconductive body, the charging unit, the developing unit and the transfer unit, wherein the move unit includes:

an urging unit that urges the power feed member to the contact position with the power-fed body; and a displacement unit that displaces the power feed member to the noncontact position with the power-fed body against the urging force of the urging unit, wherein the displacement unit includes:

a displacement section that is configured to be displaced to a first position and a second position, wherein the first position corresponds to a position when the power feed member is placed at the contact position as urged by the urging unit, and the second position corresponds to a position when the power feed member is placed at the noncontact position against the urging unit;

a move section that abuts the displacement section and moves the displacement section between the first position and the second position; and an open/closed section being opened or closed when the power-fed body is placed or detached, the open/closed section places the displacement section at the first position through the move section when the open/closed section is closed, and the open/closed section places the displacement section at the second position through the move section when the open/closed section is opened; and wherein:

a plurality of power-fed bodies are provided in the apparatus main body, placement portions of the power-fed bodies are different in order in an up and down direction, the displacement section is provided to move a plurality of power feed members corresponding to the plurality of power-fed bodies collectively between the noncontact position and the contact position, a first one of the plurality of the power feed members corresponds to a position where the move section abuts the displacement section, a second one of the plurality of the power feed members is positioned below the first one, and an end part of a part of the displacement section for moving the second one is lower than that of another part of the displacement section for moving the first one.

5. A power feeding mechanism comprising:

a power-fed body that is placed in an apparatus main body, the power-fed body into which power is fed at least when the power-fed body is used;

a placement portion where the power-fed body provided in the apparatus main body is placed;

a power feed member that is provided in the apparatus main body and is configured to move between a noncontact position and a contact position, the power feed member at the contact position feeds power into the power-fed body from the apparatus main body;

a move unit that moves the power feed member to at least the noncontact position and the contact position, wherein at the noncontact position, the power feed member is not in electric contact with the power-fed body being placed in the placement portion, and at the contact position, the power feed member is in electric contact with the power-fed body being placed in the placement portion;

a photoconductive body;

a charging unit that charges the photoconductive body;

a latent image forming unit that forms a latent image on the charged photoconductive body;

a developing unit that develops so as to visualize the latent image formed on the photoconductive body; and a transfer unit that transfers the visible image provided by the developing unit to an intermediate body or a record medium, and wherein the power-fed body contains at least one of the photoconductive body, the charging unit, the developing unit, and the transfer unit, and the power feed member feeds power into the at least one of the photoconductive body, the charging unit, the developing unit and the transfer unit, wherein the move unit includes:

an urging unit that urges the power feed member to the contact position with the power-fed body; and a displacement unit that displaces the power feed member to the noncontact position with the power-fed body against urging force of the urging unit, wherein the displacement unit includes:

a displacement section that is configured to be displaced to a first position and a second position, wherein the first position corresponds to a position when the power feed member is placed at the contact position as urged by the urging unit, and the second position corresponds to a position when the power feed member is placed at the noncontact position against the urging unit;

a move section that abuts the displacement section and moves the displacement section between the first position and the second position; and an open/closed section being opened or closed when the power-fed body is placed or detached, the open/closed section places the displacement section at the first position through the move section when the open/closed section is closed, and the open/closed section places the displacement section at the second position through the move section when the open/closed section is opened; and wherein:

a plurality of power-fed bodies are provided in the apparatus main body, placement portions of the power-fed bodies are different in order in an up and down direction, the displacement section is provided to move a plurality of power feed members corresponding to the plurality of power-fed bodies collectively between the noncontact position and the contact position, a first one of the plurality of the power feed members corresponds to a position where the move section abuts the displacement section, a second one of the plurality of the power feed members is positioned below the first one, and a part of the displacement section for moving the second one has a larger number of reinforcement projections extending in a lateral direction than another part of the displacement section for moving the first one.

6. The image forming apparatus according to claim 3, wherein the open/closed section includes:

a positioning portion that positions the power-fed body; and an operation unit that presses the power-fed body placed in a noncontact state with the positioning portion against the positioning portion.

* * * * *